US005671519A

United States Patent [19]

Naylor

[11] Patent Number: 5,671,519

[45] Date of Patent: Sep. 30, 1997

[54] YARN TEXTURING MACHINE WITH COOLING ARRANGEMENT FOR HEATED FALSE-TWISTED YARN

[75] Inventor: Geoffrey Naylor, Macclesfield, United Kingdom

[73] Assignee: Rieter Scragg Limited, Cheshire, United Kingdom

[21] Appl. No.: 650,171

[22] Filed: May 20, 1996

[30] Foreign Application Priority Data

May 23, 1995 [GB] United Kingdom ..... 9510681

[51] Int. Cl.[6] ..... D02J 13/00; D02G 1/02

[52] U.S. Cl. ..... 28/249; 57/291; 57/284; 57/290

[58] Field of Search ..... 28/249, 27; 57/289, 57/291, 284, 58.59, 280, 290

[56] References Cited

U.S. PATENT DOCUMENTS

| | | | |
|---|---|---|---|
| 2,820,876 | 1/1958 | van Dijk . | |
| 3,999,360 | 12/1976 | Forin et al. | 57/280 |
| 4,905,468 | 3/1990 | Tanae et al. | 57/284 |
| 4,993,219 | 2/1991 | Maeda et al. | 57/284 |
| 5,148,666 | 9/1992 | Bauer et al. | 57/284 |
| 5,359,845 | 11/1994 | Gabalda et al. | 28/249 |

FOREIGN PATENT DOCUMENTS

| | | | |
|---|---|---|---|
| 0 568 467 | 3/1993 | European Pat. Off. | 57/291 |
| 571 975 | 12/1993 | European Pat. Off. . | |
| 2 380 363 | 9/1978 | France . | |
| 2 381 845 | 10/1978 | France | 57/291 |
| 63-315629 | 12/1988 | Japan | 57/291 |

OTHER PUBLICATIONS

Patent Abstracts of Japan, vol. 13, No. 575, Dec. 19, 1989 and JP–A–01 239125, Sep. 25, 1989.

*Primary Examiner*—Andy Falik

*Attorney, Agent, or Firm*—Oblon, Spivak, McClelland, Maier & Neustadt, P.C.

[57] ABSTRACT

In a textile yarn texturing machine, a cooling arrangement for the heated false-twisted yarn is provided by a tube having a guide at the inlet end and a guide on the diametrically opposed side of the tube at the outlet end to guide the yarn in a helical path around the outer surface of the tube. The yarn makes one-half turn around the tube during its travel from the inlet end to the outlet end. Holes on the yarn path in the first part of the tube are connected to a suction device for fume extraction, and a cooling fluid may be passed through the tube to enhance cooling. The tube may form the second part of the cooling arrangement and is preferably inclined downwardly from a horizontally disposed first part towards the false twist device. The cooling arrangement or at least the first part is aligned with the preferably horizontally disposed heater located above the operator's aisle of the machine.

20 Claims, 5 Drawing Sheets

38
21
37
38

38
21
39
38

38
21
37
39
38

YARN TEXTURING MACHINE WITH COOLING ARRANGEMENT FOR HEATED FALSE-TWISTED YARN

FIELD OF THE INVENTION

This invention relates to textile machines, and in particular to machines for texturing textile yarns by false twisting, heating and cooling the false twisted yarn, and winding up such yarns.

BACKGROUND OF THE INVENTION

Textile machines of this type are well known. As the yarn throughput speeds of such machines have increased, the length of the heating and cooling devices have increased accordingly to ensure that the yarn is sufficiently heated then cooled for the false twisting of the yarn to be performed effectively. This has resulted in increasingly large machines that require an excessive amount of space in a factory and are inconvenient to operate and maintain. As a consequence, many proposals have been put forward in order to overcome the problems associated with the size of such machines. European patent 330368 (corresponding to U.S. Pat. No. 4,905,468) is directed to one such arrangement wherein one operator's aisle is disposed between a creel and a take-up section, and another operator's aisle is disposed between the take-up section and a section containing the false-twisting units and second feed devices. For each yarn processing station, a first heater inclined downwardly at an angle of approximately 50° to the horizontal and a first cooling device aligned with the heater are disposed above the operator's aisles, with a second cooling device vertically disposed between the first cooling device and the false-twisting unit. Such an arrangement has been proposed in order to reduce the angle through which the path of the heated yarn turns between the inlet end of the first heater to the false-twist unit to facilitate the passage of twist back along that path, and at the same time to overcome the various disadvantages described in that patent and associated with previously proposed arrangements shown in FIGS. 2 to 4 of that patent. However the arrangement to which that patent is directed still has the disadvantages of providing a machine whose height is considerable, and for which threading up is difficult.

OBJECT OF THE INVENTION

It is an object of the present invention to provide an arrangement for a textile machine, in particular a false-twist texturing machine, in which the cooling of the yarn is effected more efficiently than in the known arrangements and which enables a machine configuration to be adopted which avoids the disadvantage of the arrangement to which EP 330368 is directed as well as the disadvantages of the prior arrangements described in that patent.

SUMMARY OF THE INVENTION

The invention provides a yarn texturing machine comprising; a first frame adapted to support a package of a supply yarn, a first yarn feed device; a heating device, a cooling arrangement, a false-twist device and a second feed device; wherein the cooling arrangement comprises a tube having yarn guides disposed adjacent the inlet and outlet ends thereof and positioned to guide a running yarn in a substantially helical path along the outer surface of the tube. The guides may be disposed on diametrically opposed sides of the tube to provide a yarn path of substantially one half turn around the surface of the tube. At least a first part of the cooling arrangement may be connected to a suction device for the removal of fumes from the yarn. The tube may have at least one hole in the surface thereof located on the yarn path, in which case the hole may be in communication with the suction device for withdrawing fumes through the hole. A plurality of holes in communication with the suction device may be provided along at least a first part of the yarn path along the tube. A cooling fluid supply arrangement may be connected to the tube whereby a cooling fluid may be passed through the tube.

The machine may comprise a second frame supporting the false twist device and an operator's aisle between the first and second frames, with the heating device and the cooling arrangement disposed above the operator's aisle. At least an outlet section of the cooling arrangement may be inclined downwardly towards the false twist device. Preferably at least an inlet section of the cooling arrangement is substantially aligned with the heating device, which may be substantially horizontally disposed. The inlet cooling section may have a cooling device therein.

The outlet cooling section may be inclined between 10° and 60° to the horizontal, and may be mounted on the second frame so as to be pivotal downwardly about the outlet end to facilitate the threading of a yarn in the machine. Alternatively a yarn guide may be movable from a threading position at the height of the outlet end to an operating position between the inlet and outlet cooling sections. As a further alternative the cooling arrangement may comprise an upwardly convex plate adapted to receive a running yarn on an upper surface thereof.

The heating device may be a heater adapted to operate at a temperature above 300° C., and preferably between 450° C. and 800° C., which preferably is downwardly facing. The machine may comprise a sledge slidable longitudinally of a sledge track extending between the first yarn feed device and an inlet end of the heating device. The machine may comprise a second heating device, which may be mounted in the second frame. The machine may also comprise a take-up section, which may be disposed in the second frame. Alternatively the take-up section may be disposed in a third frame located between and spaced from the first and second frames. The first yarn feed device may be mounted on the first frame or in the alternative case on the third frame.

The invention may also provide a yarn texturing machine comprising; a first frame adapted to support a package of supply yarn, a first yarn feed device, a heating device, a cooling arrangement, a second frame supporting a false twist device and having an operator's aisle between the first and second frames, with the heating device disposed substantially horizontally above the operator's aisle, and the cooling arrangement having at least an outlet section inclined downwardly towards the false-twist device. At least the outlet section of the cooling arrangement may comprise a tube having yarn guides disposed adjacent the inlet and outlet ends thereof and positioned to guide a running yarn in a helical path along the outer surface of the tube.

BRIEF DESCRIPTION OF THE DRAWINGS

Embodiments of the invention will now be described with reference to the accompanying drawings in which.

DESCRIPTION OF THE PREFERRED EMBODIMENTS

Figure 1:
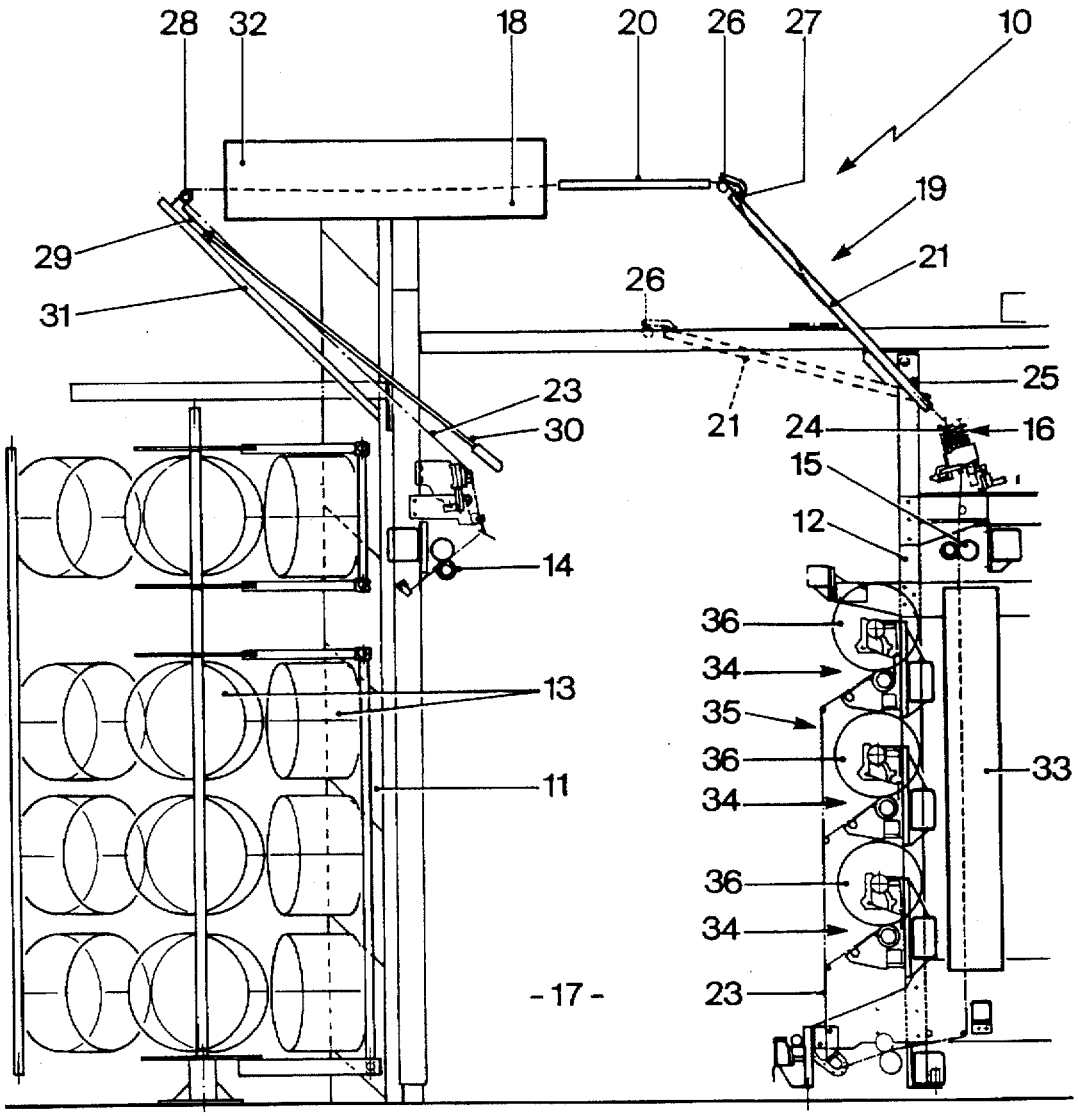
FIG. 1 is a threadline diagram of one embodiment.
Figures 2A, 2B, 2C:
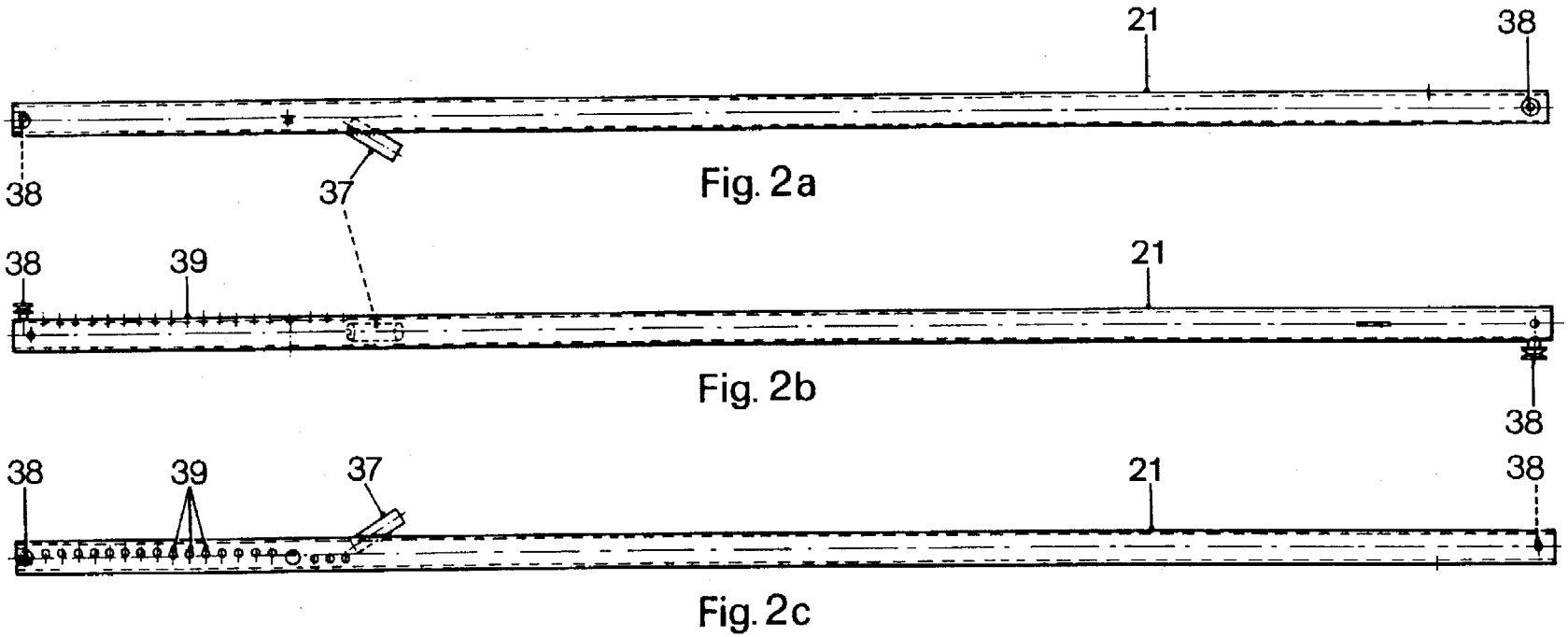
FIGS. 2*a*, *b* and *c* are respectively a first side view, plan and second side view of the outlet cooling section of FIG. 1, FIG. 3 and 4 are scrap views of variations of the embodiment of FIG. 1.
Figure 3:
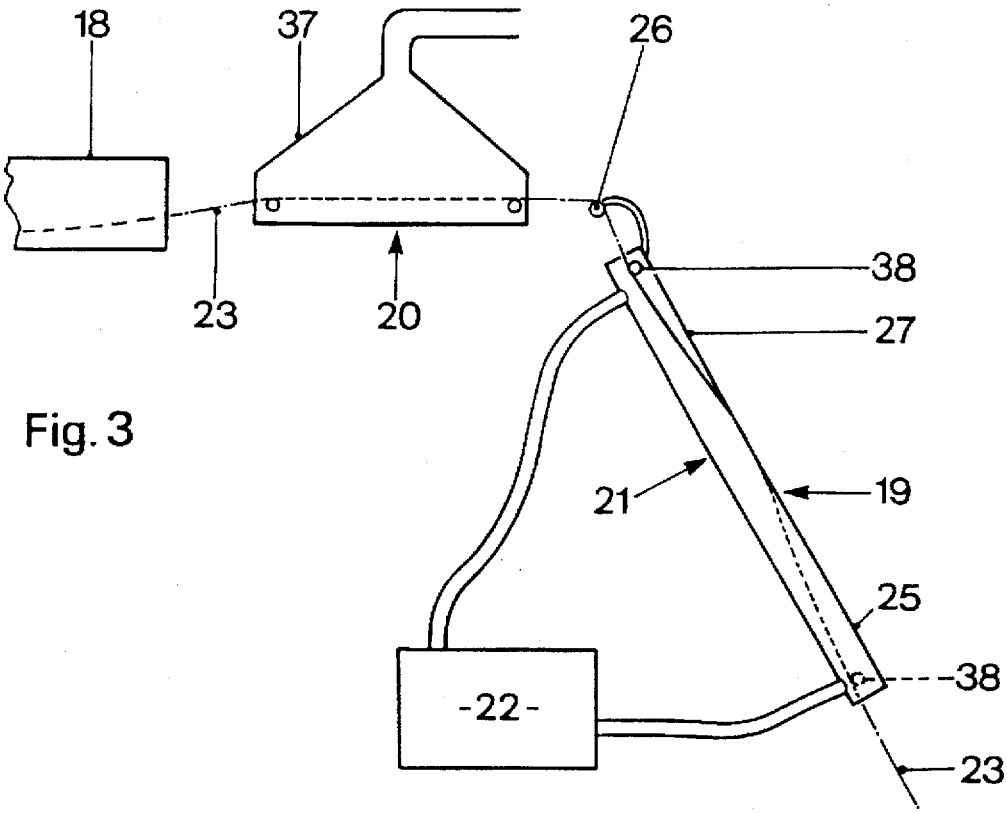
Figure 4:
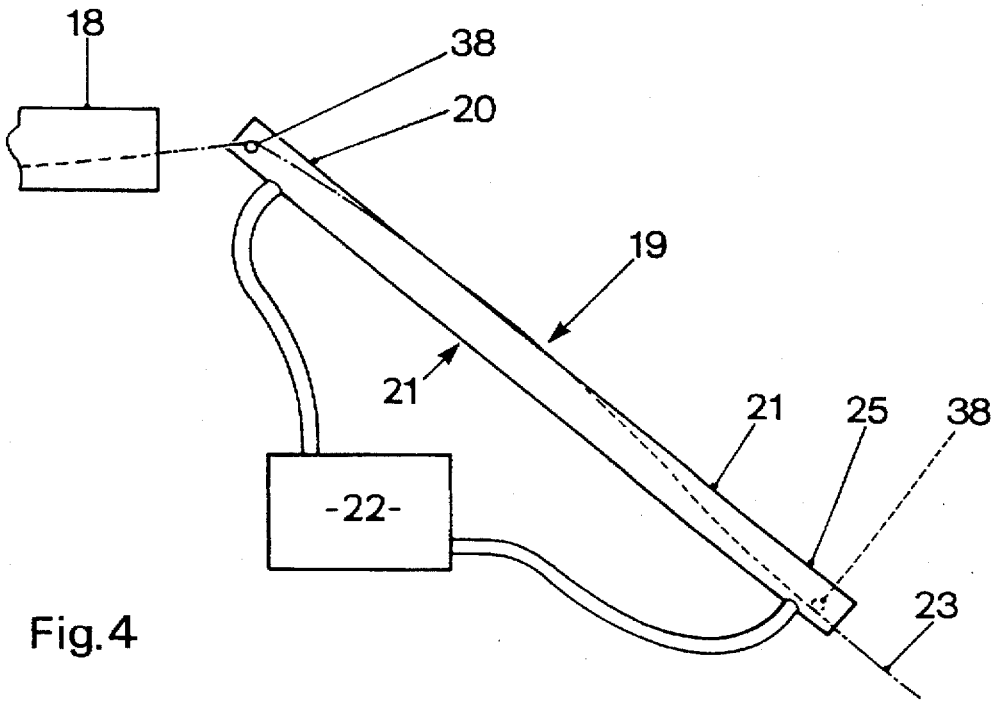

Referring to FIG. 1, there is shown a textile machine 10, comprising a first frame 11 and a second frame 12. Mounted in the first frame 11 are several packages 13 of supply yarn. Also mounted on the first frame 11 is a first feed device 14 in the form of a feed and nip roller pair. Mounted on the second frame 12 is a second feed device 15, also in the form of a feed and nip roller pair, and a false-twist device 16. The frames 11, 12 are spaced from each other to provide an operator's aisle 17 between them. Above the operator's aisle 17 is a substantially horizontally disposed downwardly facing first heating device 18 and a cooling arrangement 19. To reduce the length of heating device required for adequate heating of the yarn 23, the first heating device 18 operates at a temperature above the melting point of the yarn 23, i.e. above 300° C., and preferably between 450° C. and 800° C. The cooling arrangement 19 is in the form of a relatively short plate or other device forming the inlet cooling section 20 which is also substantially horizontally disposed, and aligned with the first heating device 18, and a longer outlet cooling section 21 disposed between the inlet cooling section 20 and the false-twist device 16. In this case the outlet cooling section 21 comprises a tube having guides 38 disposed adjacent the inlet and outlet ends thereof and positioned on opposed sides of the tube to guide a running yarn 23 in a helical path, making approximately one half turn as it travels the length of the outlet cooling section 21 as shown in FIGS. 2 to 4. With this arrangement, a cooling fluid may be passed through the tube 21 from a cooling fluid supply device 22 to enhance the cooling effect and thereby reduce the length of the outlet cooling section 21 required for adequate cooling of the yarn 23. The outlet cooling section device 21 is inclined downwardly towards the false-twist device 16 at an angle of between 10° and 60° to the horizontal, thereby aligning the incoming yarn 23 to pass over the surface of the first friction disc 24 of the false-twist device 16 at the desired angle. The outlet cooling section tube 21 is mounted on the second frame 12 so as to be pivotal about its outlet end 25 downwardly to the threading position shown in dotted lines. This enables the yarn 23 to be threaded over a yarn guide 26 mounted adjacent the inlet end 27 of the second cooling section tube 21, which can then be pivoted upwardly into the operating position shown in full lines. At this stage of the threading procedure the yarn 23 will extend in a straight line between the first yarn feed device 14 and the yarn guide 26. The yarn 23 is then passed over a yarn guide 28 on a sledge 29 which is pushed by means of a rod 30 so as to slide along a sledge track 31 extending between the first yarn feed device 14 and the inlet end 32 of the first heating device 18. This places the yarn 23 firstly in contact with the first cooling section device 20 and then in contact with the downwardly facing first heating device 18. After passing through the false-twist device 16, the yarn 23 passes through the second feed device 15 to an optional second heating device 33 and to a package winding mechanism 34 located in a take-up section 35. The second heating device 33, if fitted, and the take-up section 35 are disposed in the second frame 12, the take-up section facing the first frame 11 across the operator's aisle 17. In this case the packages 36 of textured yarn are removed from the machine 10 by the operator or by an automatic doffing mechanism (not shown) operating in the operator's aisle 17.

Alternatively the plate or other device of the first cooling section 20 may be omitted as shown in FIG. 4, or the yarn 23 cooled in this section by passing through the air at ambient temperature as shown in FIG. 3. In either case the first part of the cooling tube 21 may have a plurality of holes 39 (FIGS. 2*b* & *c*) in the surface along the path of the yarn 23, which holes 39 are connected to a suction fume extraction device 37. Alternatively or in addition, as shown in FIG. 3, a fume extraction device 37 may be provided in the first cooling section 20. As an alternative to the pivoting of the second cooling section device 21, the yarn guide 26 may be slidable along the second cooling section device 21 between the outlet end 25 where it is initially positioned for threading and its operating position adjacent the inlet end 27.

Figure 5:
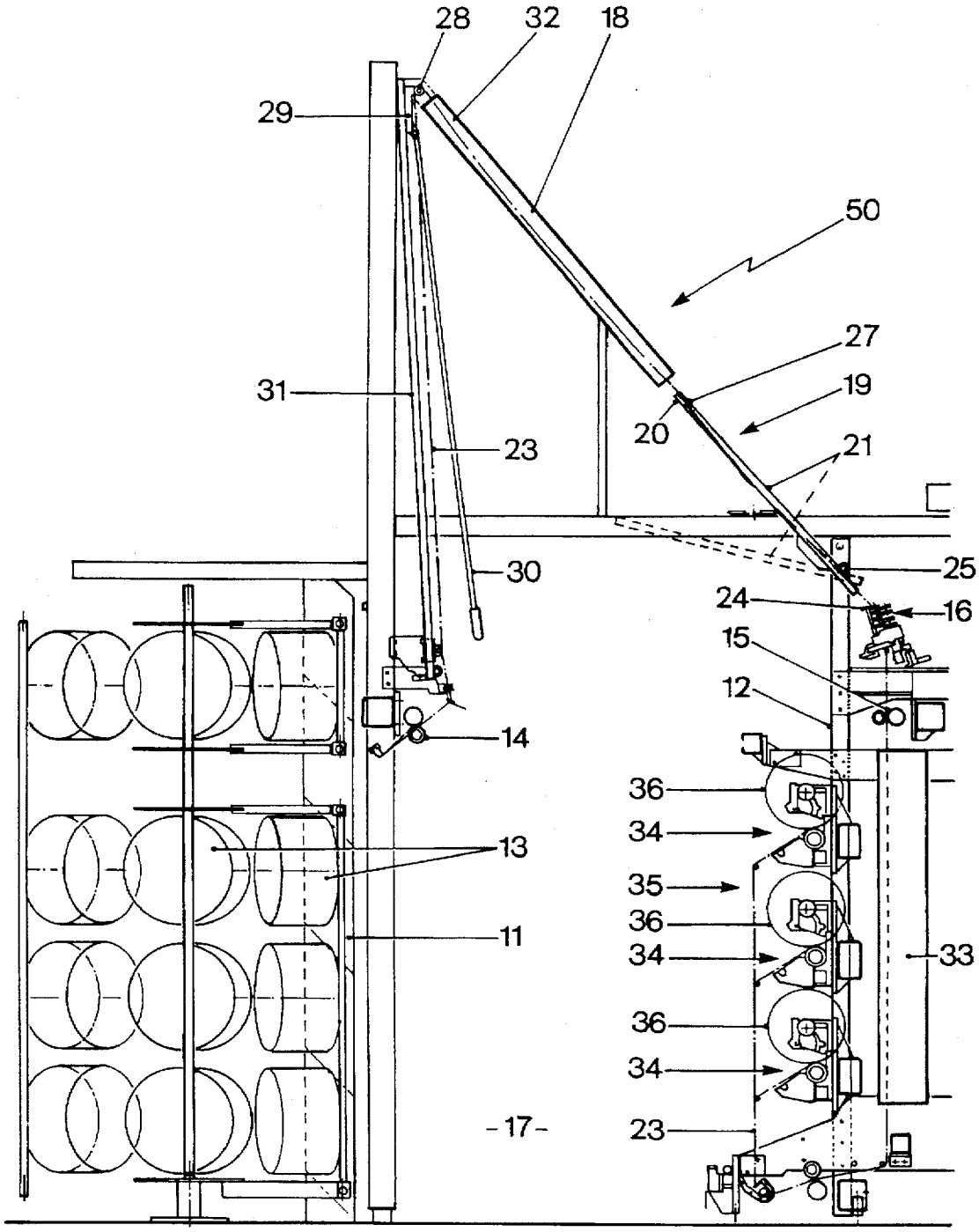
FIG. 5 is a threadline diagram of a second embodiment.

In the event that, for certain yarns 23, the bend in the yarn path between the first feed device 14 and the false twist device 16 precludes the proper travel of the twist through the cooling arrangement 19 and across the heating device 18, the cooling arrangement 19 and the heating device 18 may be mutually aligned and horizontally disposed or inclined downwardly towards the false twist device 16, the latter being as in the case of machine 50 shown in FIG. 5.

Figure 6:
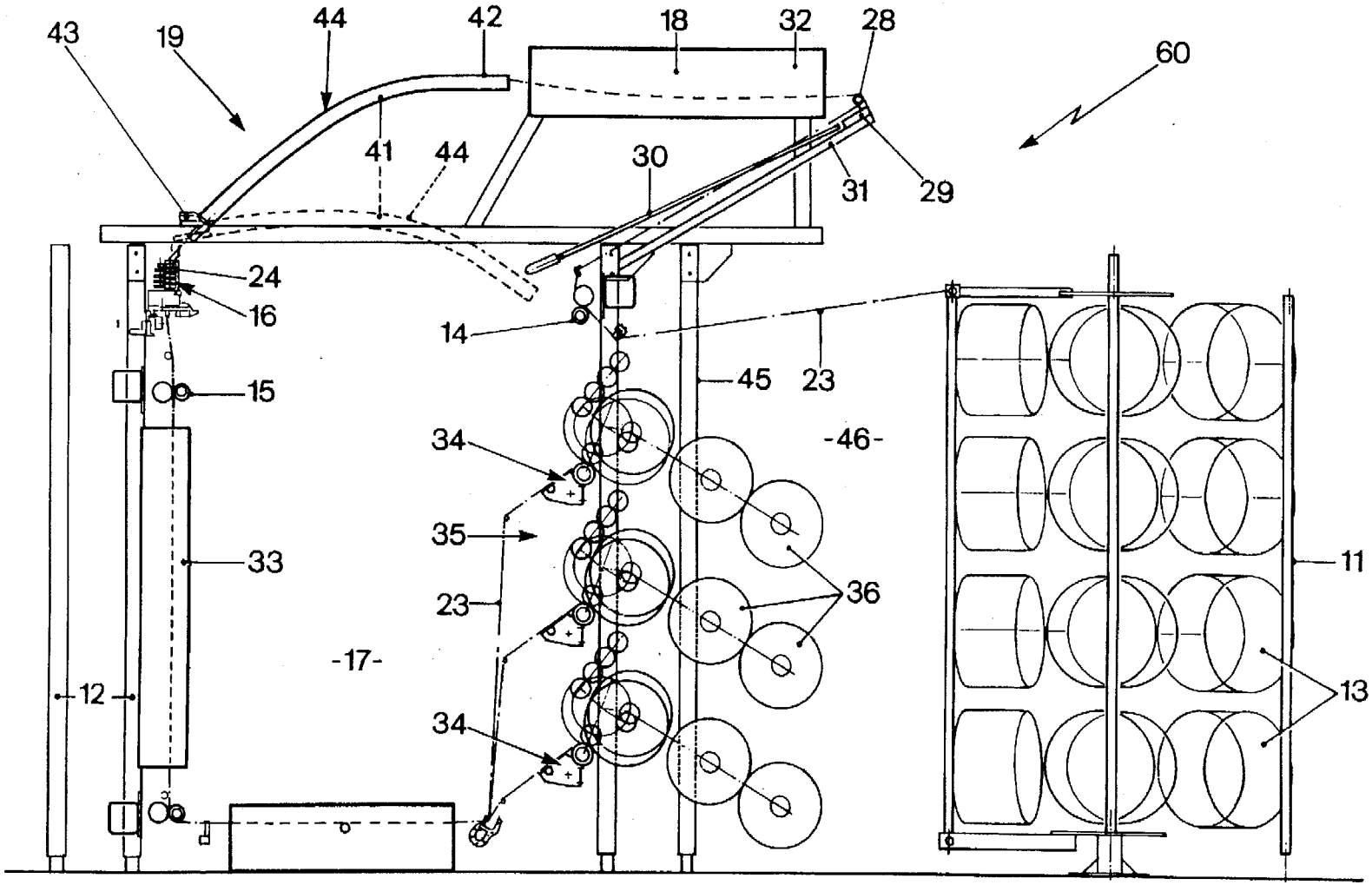
FIG. 6 is a threadline diagram of a third embodiment

Referring now to FIG. 6, there is shown a textile machine 60 in which most of the parts are identical with the corresponding parts of the previous embodiment and are identified by the same reference numerals. However, in this case the first feed device 14 is mounted on a third frame 45 spaced from the second frame 12 by the operator's aisle 17 and spaced from the first frame 11 by a second aisle 46. In addition, the cooling arrangement 19 comprises an upwardly convex plate 41 whose inlet end 42 is horizontally aligned with the first heating device 18 and whose outlet end 43 is inclined at an angle of between 10° and 60° to the horizontal, thereby aligning the incoming yarn 23 to pass over the surface of the first friction disc 24 of the false-twist device 16 at the desired angle. The plate 41 is mounted on the second frame 12 so as to be pivotal about its outlet end 43 downwardly to the threading position shown in dotted lines. This enables the yarn 23 to be threaded on the upper surface 44 of the plate 41, which is then pivoted upwardly into the operating position shown in full lines. At this stage of the threading procedure the yarn 23 will extend in a straight line between the first yarn feed device 14 and the inlet end 42. The sledge 29 is then moved along the track 31 to place the yarn 23 on the downwardly facing first heating device 18 as in the previous embodiment. As an alternative to the pivoting of the upwardly convex cooling plate 41, a yarn guide corresponding with guide 26 of the previous embodiment may be slidable along the plate 41 between the outlet end 43 where it is initially positioned for threading and an operating position at the inlet end 42. After passing through the false-twist device 16, the yarn 23 passes through the second feed device 15 to a second heating device 33 and to a package winding mechanism 34 located in a take-up section 35. The second heating device 33 is disposed in the second frame 12, but in this embodiment the take-up section 35 is disposed in the third frame 45. This arrangement allows the packages 36 of textured yarn to pass automatically to the rear of the take-up section 35 for removal by an automatic doffing mechanism (not shown) operating in the second aisle 46.

By means of the invention a textile machine for texturing textile yarns is provided in which the cooling of the heated and false twisted yarn is more efficient than that of prior known arrangements, resulting in a shorter cooling zone and hence a smaller overall machine size than was the case heretofore. In addition the principle embodiments of the present machine are ones of a height which is convenient for use and maintenance, and in which the angle through which the yarn path turns from the inlet end 32 of the first heating device 18 to the false-twist device 16 is not excessive, in particular while the yarn 23 is heated, to facilitate the passage of twist back along that path. That angle may be further reduced if the false twist devices 16 are inclined from the vertical towards the first heating devices 18. Such an arrangement requires a shorter sledge track than is required with prior arrangements having either a vertical heater mounted above the first feed device or a downwardly inclined heater having its inlet end a substantial height above the first feed device. The present arrangement appreciably improves the stability of the false twist process. Further advantages accrue from the horizontally disposed first heating devices 18 which are downwardly facing and provide better heat transfer to the yarn 23 than is the case with vertical or inclined heating devices. In addition there is less contamination of the surfaces of the heating and cooling devices 18, 20, 21, 41 with such an arrangement. Furthermore, if a yarn 23 breaks, the free ends readily fall from the surface of the first heating devices 18, thereby preventing or minimising the amount of burning of the yarn 23 on the heated surface.

What is claimed is:

1. A yarn texturing machine comprising:

a first frame adapted to support a package of a supply yarn;

a first yarn feed device;

a heating device;

a cooling arrangement;

a false-twist device and a second feed device wherein the cooling arrangement comprises a tube having an outer surface and inlet and outlet ends and having yarn guides disposed adjacent the inlet and outlet ends and positioned to guide a running yarn in a substantially helical path along the outer surface and wherein the tube has a first part and at least one hole is provided in the outer surface located on the yarn path along at least the first part.

2. A yarn texturing machine according to claim 1, wherein the tube has diametrically opposed sides and the guides are disposed on the diametrically opposed sides to provide a yarn path of substantially one half turn around the outer surface.

3. A yarn texturing machine according to claim 1, comprising a suction device, wherein the at least one hole is in communication with the suction device for withdrawing fumes through the hole.

4. A yarn texturing machine according to claim 1, wherein a cooling fluid supply arrangement is connected to the tube such that a cooling fluid is passable through the tube.

5. A yarn texturing machine according to claim 1, comprising a second frame supporting the false twist device and an operator's aisle between the first and second frame, wherein the heating device and the cooling arrangement are disposed above the operator's aisle.

6. A yarn texturing machine according to claim 5, comprising a second heating device, wherein the second heating device is mounted in the second frame.

7. A yarn texturing machine according to claim 5, comprising a take-up section, wherein the take-up section is disposed in the second frame.

8. A yarn texturing machine according to claim 5, wherein the machine comprises a third frame located between and spaced from the first and second frames and a take-up section which is disposed in the third frame.

9. A yarn texturing machine according to claim 8, wherein the first yarn feed device is mounted on the third frame.

10. A yarn texturing machine according to claim 5, wherein the cooling arrangement has a section leading to the outlet end which is inclined downwardly towards the false twist device.

11. A yarn texturing machine according to claim 10, wherein the cooling arrangement has a first section which is substantially aligned with the heating device.

12. A yarn texturing machine according to claim 10, wherein the section leading to the outlet end of the cooling arrangement is inclined at between 10° and 60° to the horizontal.

13. A yarn texturing machine according to claim 10, wherein the section leading to the outlet end of the cooling arrangement is mounted on the second frame so as to be pivotal downwardly about the outlet end to facilitate the threading of a yarn in the machine.

14. A yarn texturing machine according to claim 10, which comprises a yarn guide which is movable along the tube from a threading position adjacent the outlet end and to an operating position adjacent the inlet end.

15. A yarn texturing machine according to claim 11, wherein the heating device is substantially horizontally disposed.

16. A yarn texturing machine according to claim 1 wherein the heating device is a heater adapted to operate at a temperature above 300° C.

17. A yarn texturing machine, comprising;

a first frame adapted to support a package of supply yarn;

a first yarn feed device;

a heating device;

a cooling arrangement;

a false twist device;

a second frame supporting the false twist device and having an operator's aisle between the first and second frames, with the heating device disposed substantially horizontally above the operator's aisle, and the cooling arrangement having an outer surface to receive a running yarn in a yarn path thereon, an outlet end, at least a section leading to the outlet end which is inclined downwardly towards the false-twist device, a first part and at least one hole in the outer surface located on the yarn along at least the first part.

18. A yarn texturing machine according to claim 17, wherein the cooling arrangement comprises a tube having an outer surface and an inlet end and said outlet end and having yarn guides disposed adjacent the inlet and outlet ends and positioned to guide a running yarn in a substantially helical path along the outer surface.

19. A yarn texturing machine according to claim 17, wherein the cooling arrangement comprises an upwardly convex plate adapted to receive a running yarn on an upper surface thereof.

20. A yarn texturing machine according to claim 18, which comprises a suction device, wherein the at least one hole is in communication with the suction device, the suction device withdrawing fumes through the hole.

* * * * *